US007204726B2

(12) United States Patent
Yamashita et al.

(10) Patent No.: US 7,204,726 B2
(45) Date of Patent: Apr. 17, 2007

(54) ELECTRICAL CONNECTOR WITH A TERMINAL RETAINER WITH AN INTERMEDIATE LOCK

(75) Inventors: Kazunori Yamashita, Yokkaichi (JP); Toshio Yamakado, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/360,196

(22) Filed: Feb. 23, 2006

(65) Prior Publication Data

US 2006/0189219 A1 Aug. 24, 2006

(30) Foreign Application Priority Data

Feb. 23, 2005 (JP) ..... 2005-047549

(51) Int. Cl.
*H01R 13/514* (2006.01)

(52) U.S. Cl. ..... 439/752

(58) Field of Classification Search ..... 439/752, 439/595, 357, 345, 352
See application file for complete search history.

(56) References Cited

U.S. PATENT DOCUMENTS 4,722,698 A * 2/1988 Modschiedler ..... 439/374
5,797,772 A * 8/1998 Sakurai et al. ..... 439/752
5,947,775 A 9/1999 Yamamoto et al.
7,033,201 B2 * 4/2006 Ichida et al. ..... 439/352
2001/0035652 A1 * 11/2001 Wada et al. ..... 292/128
2003/0060075 A1 * 3/2003 Nakamura et al. ..... 439/345
2004/0008494 A1 * 1/2004 Roth ..... 361/736

* cited by examiner

*Primary Examiner*—Chandrika Prasad
(74) *Attorney, Agent, or Firm*—Gerald E. Hespos; Anthony J. Casella

(57) ABSTRACT

A connector has a housing (10) with cavities (12) for accommodating terminal fittings (30). A retainer-mounting hole (17) is formed in a side of the housing (10) and communicates with the cavities (12). A retainer (50) can be mounted in the retainer-mounting hole (17) at a predetermined normal depth to lock the terminal fittings (30) in the cavities (12). The retainer (50) has side locks (61) at both sides of the retainer (50) that lock to a corresponding side to-be-locked surface (22) in the housing (10). The retainer (10) also has an intermediate lock (68) at a central position of the retainer (50) that locks to an intermediate to-be-locked surface (22) in the housing (10). The blocking strength of the intermediate lock (68) exceeds the locking strength of the side locks (61).

10 Claims, 13 Drawing Sheets

ELECTRICAL CONNECTOR WITH A TERMINAL RETAINER WITH AN INTERMEDIATE LOCK

BACKGROUND OF THE INVENTION

1. Field of the Invention

The present invention relates to a connector having a retainer.

2. Description of the Related Art

U.S. Pat. No. 5,947,775 discloses a connector with a housing that has cavities for receiving terminal fittings. The connector also has a retainer that is made of a synthetic resin. The retainer has a base with opposite left and right ends and left and right side plates that project from the respective left and right ends of the base. The side plates retainer can be mounted to the housing in a direction transverse to the insertion direction of the terminal fittings into the cavities. Thus, locks on the side plates of the retainer engage to-be-locked portions on side walls of the housing to hold the retainer in a position where the base of the retainer engages the terminal fittings to retain the terminal fittings in the cavities.

The multi-polarity of connectors has led to a plurality of cavities arranged in a widthwise direction of the housing. As a result, the base of the retainer has become long in a widthwise direction, and a central portion of the base may be weak. The locks on the left and right side plates of the retainer may engage the to-be-locked portions of the housing. However, the widthwise central portion of the retainer may warp. There is a fear that an operator may insert the terminal fittings into the housing and move the retainer into a locking position without realizing that the central portion of the base is not in a position to engage the corresponding terminal fitting.

The present invention has been completed in view of the above-described situation. Therefore it is an object of the present invention to prevent a terminal fitting from being left in a semi-insertion state.

SUMMARY OF THE INVENTION

The invention relates to a connector with a housing that has cavities arranged in a widthwise direction and configured for receiving terminal fittings. A retainer-mounting hole is formed in an outer surface of the housing and communicates with the cavities. A retainer is mounted in the retainer-mounting hole at a predetermined normal depth to hold the terminal fittings in the cavities. The retainer has a locking means for locking a to-be-locked surface of the housing when the retainer is mounted in the retainer-mounting hole at the normal depth. The locking means includes side locks at the widthwise sides of the retainer and an intermediate lock between the end locks. A locking strength of the intermediate lock for the to-be-locked surface of the housing is larger than a locking strength of each end lock for the to-be-locked surface of the housing.

An overlap length of the locking surface for the to-be-locked surface of the housing preferably is larger at the intermediate lock than at the side locks. This way of adjusting the locking strength allows the connector to be manufactured more easily than adjusting the locking strength by differentiating a material for the intermediate lock and a material for the side locks from each other.

The intermediate lock preferably is at a central widthwise position of the retainer. Therefore the retainer is balanced well and the retainer-mounting work can be accomplished smoothly.

Detectors preferably project from the housing and the retainer. The retainer is mounted in the retainer-mounting hole at the normal depth and the terminal fittings are inserted into the cavities. Thus, a leading end of the detector of the housing and a leading end of the detector of the retainer are flush with each other. However, the retainer is not at the normal depth in the retainer-mounting hole when the terminal fittings are left in a semi-inserted state in the cavities. Thus, the leading end of the detector of the housing and the leading end of the detector of the retainer are not flush with each other.

The terminal fittings are inserted into the respective cavities and the retainer then is mounted in the retainer-mounting hole. The side locks of the retainer lock the corresponding to-be-locked surfaces of the housing when the retainer is mounted in the retainer-mounting hole at the normal depth. At this time, the intermediate lock also locks the corresponding to-be-locked surface of the housing. As a result, the terminal fittings are held in the respective cavities. The retainer is long in the width direction. However, the intermediate lock and the side locks prevent the central portion of the retainer from warping. The locking strength of the intermediate lock exceeds the locking strength of the side locks. Therefore, neither the intermediate lock nor the side locks lock if the terminal fittings are left in a semi-inserted state at the central portion of the housing. Similarly, if the terminal fittings at one end of the housing are left in a semi-inserted state, the side lock at the side of the housing is not locked, and the retainer deforms up at its side. Therefore, the semi-inserted state of the terminal fitting can be confirmed visually.

The retainer preferably is mounted in the retainer-mounting hole at the predetermined normal depth when the terminal fittings are inserted into the respective cavities. Therefore, the leading end of the detector of the housing and the leading end of the detector of the retainer are flush with each other. The retainer is not mounted in the retainer-mounting hole at the predetermined normal depth when the terminal fittings are left in the semi-inserted state in the cavities. Thus, the leading end of the detector of the housing and the leading end of the detector of the retainer are not flush with each other. Therefore by visually checking the positions of the leading ends of both detectors, it is easy to detect that the terminal fittings have been semi-inserted into the cavities.

DETAILED DESCRIPTION OF THE PREFERRED EMBODIMENTS

A female connector according to the invention includes a housing identified generally by the numeral 10 in FIGS. 1 through 13. The housing 10 is molded unitarily from a synthetic resin and has opposite front and rear ends. The front end of the housing 10 is at the left side in FIG. 1, and is configured to mate with a male connector (not shown). The term vertical is used herein as a convenient frame of reference and refers to the orientation of the housing 10 shown in FIG. 1.

Figure 7:
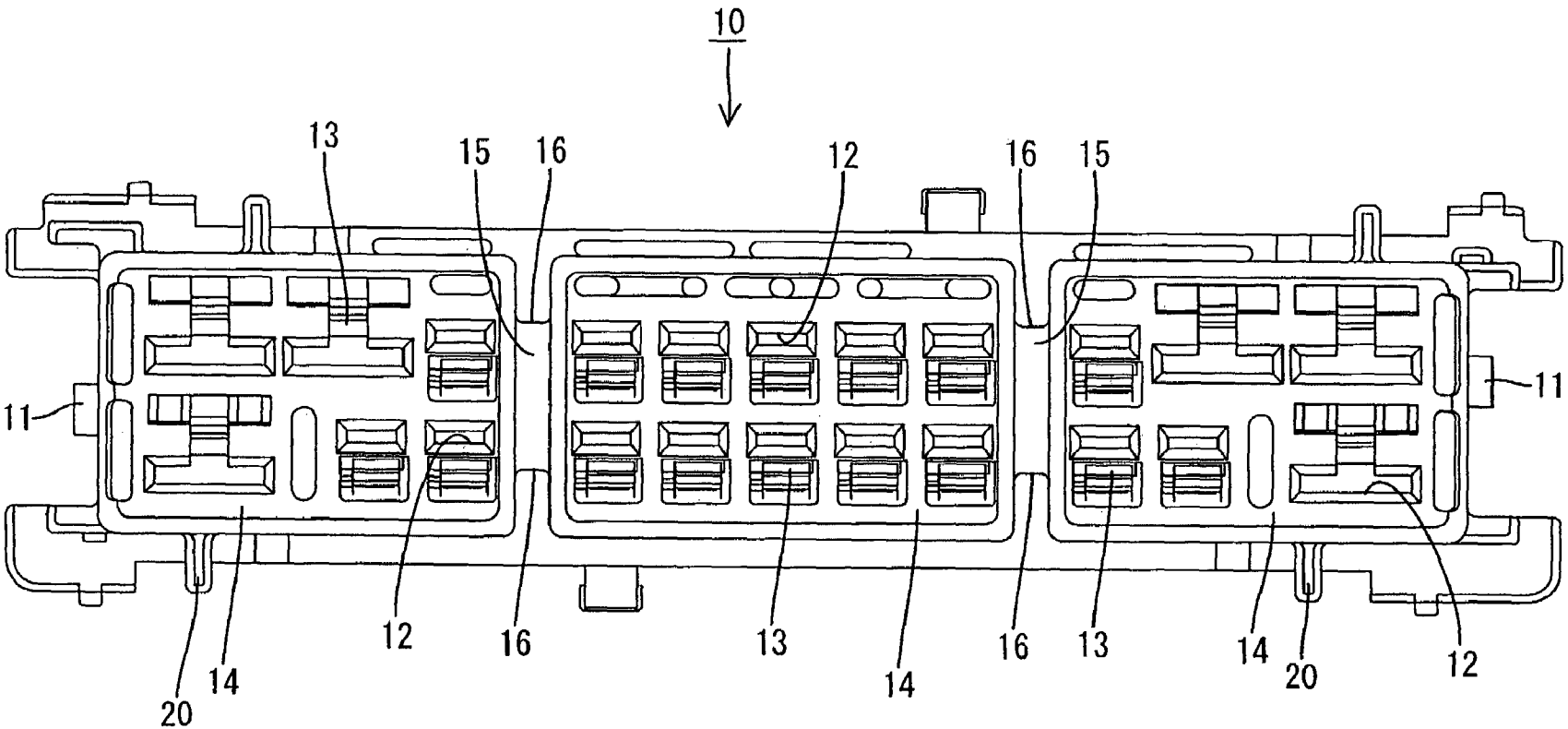
FIG. 7 is a front view showing a housing.

Right and left locking projections 11 are formed on the opposite right and left sides of the housing 10, as shown in FIG. 7, and are configured to be locked to the male connector. Cavities 12 extend from the rear end of the housing 10 towards the front end and are arranged side-by-side in upper and lower stages. A female terminal fitting 30 can be inserted into each cavity 12 from the rear end of the housing 10. A resiliently deformable lance 13 is cantilevered forwardly from the bottom wall of each cavity 12 and is configured for locking the terminal fitting 30.

The cavities 12 are arranged in three groups 14 across the width of the housing 10, and the cavities 12 in adjacent groups 14 are partitioned from each other by partitioning walls 15, as shown in FIG. 7. Guide grooves 16 are formed in the upper and lower surfaces of each partitioning wall 15 and extend longitudinally for guiding the female connector into engagement with the male connector.

Figure 8:
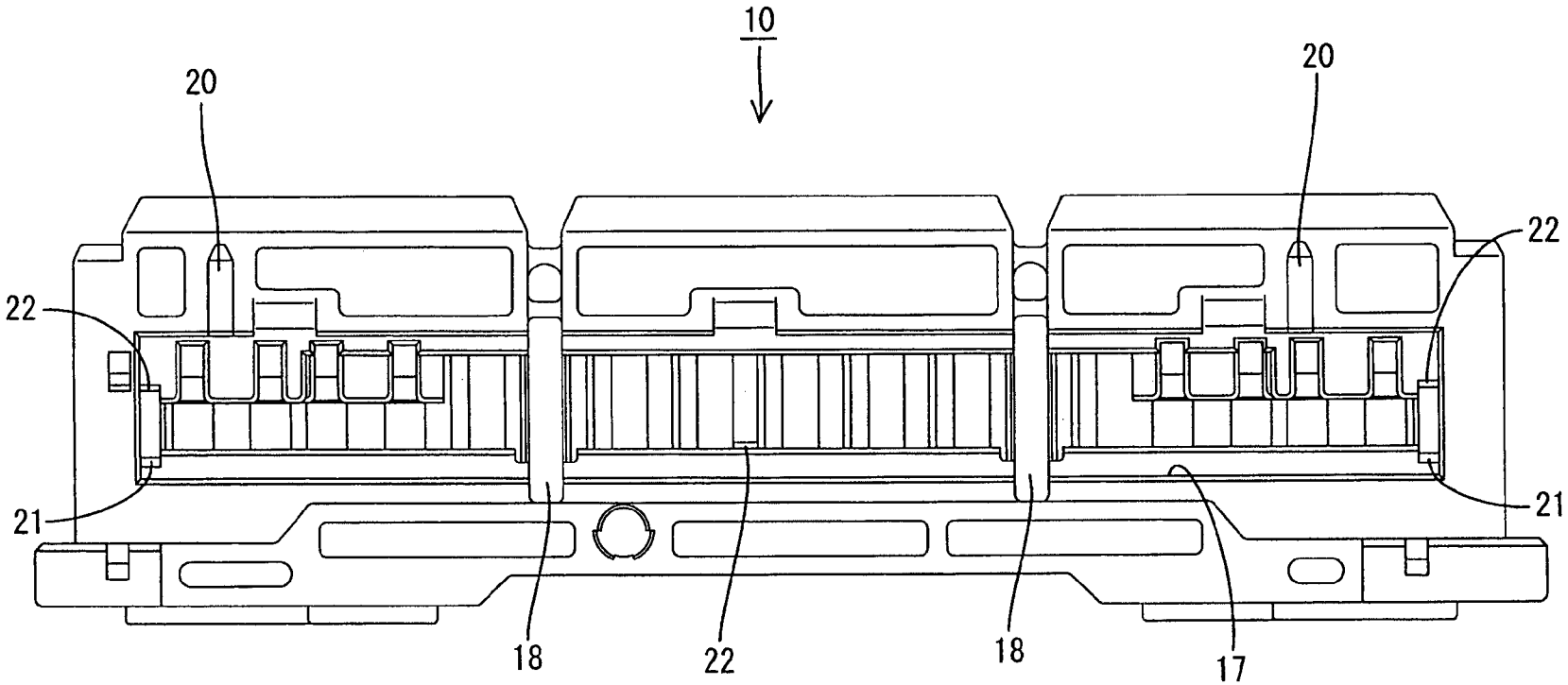
FIG. 8 is a bottom view showing the housing.

A retainer-mounting hole 17 opens into the bottom surface of the housing 10, as shown in FIG. 8. The retainer-mounting hole 17 extends across almost the entire bottom surface of the housing 10 in the width direction, including the partitioning walls 15. Additionally, the retainer-mounting hole 17 has a depth to communicate with the cavities 12 in both the upper and lower stages. A rib 18 projects from a bottom surface of the retainer-mounting hole 17 at a position corresponding to the guide groove 16. Steps 19 extend across front and rear edges of the entrance to the retainer-mounting hole 17.

Left and right detectors 20 project down substantially symmetrically from positions near the left and right sides of the lower surface of the housing 10, as shown in FIG. 7. Each detector 20 is substantially plate-shaped and extends forward from a front edge of the retainer-mounting hole 17.

Side to-be-locked portions 23 are formed inside the housing 10 at the right and left sides of the retainer-mounting hole 17. As shown in FIG. 9A, opposed rear and front wall surfaces are formed inside the side to-be-locked portions 23. A temporary locking projection 24 projects in from the rear wall surface and a main locking projection 25 projects in from the front wall surface. The temporary and main locking projections 24 and 25 have different respective heights. Temporary to-be-locked surfaces 21 are formed on the tops of the temporary locking projections 24 and are aligned approximately horizontally. Main to-be-locked surface 22 are formed on the tops of the main locking projections 25 and also are aligned approximately horizontally.

Figure 10B:
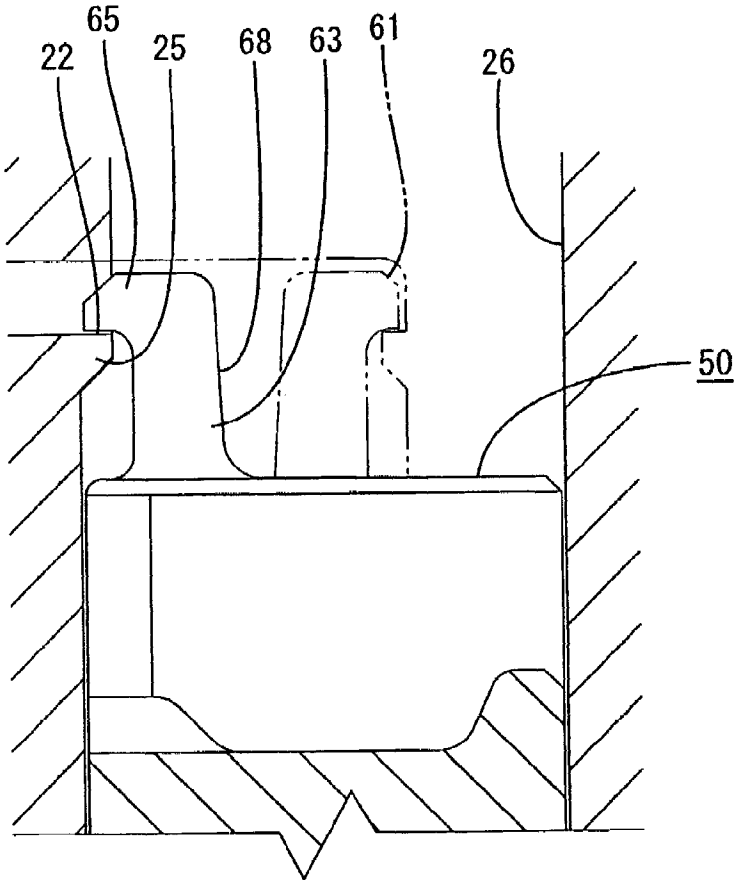
FIG. 10B is a sectional view showing the state of the intermediate locking portion when the retainer is disposed at the main locking position.

An intermediate to-be-locked portion 26 is formed inside the housing 10 at a widthwise intermediate position. As shown in FIG. 10B, opposed front and rear wall surfaces are formed inside the intermediate to-be-locked portion 26. A main locking projection 25 projects in from the rear wall surface of the intermediate to-be-locked portion 26, and a main to-be-locked surface 22 extends approximately horizontally on the top of the main locking projection 25.

Figure 2:
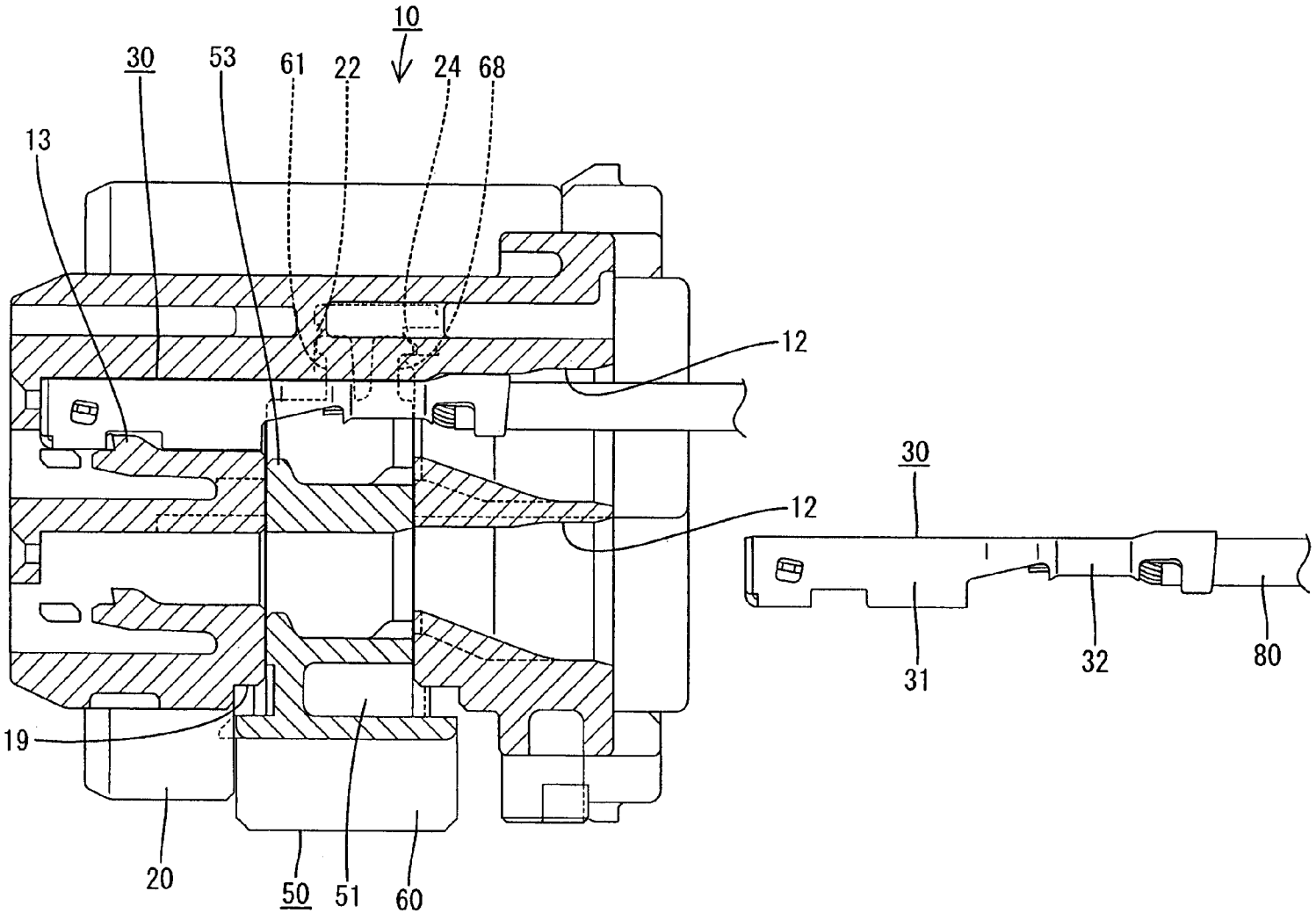
FIG. 2 is a sectional view showing a state in which the retainer is disposed at a temporary locking position.
Figure 3:
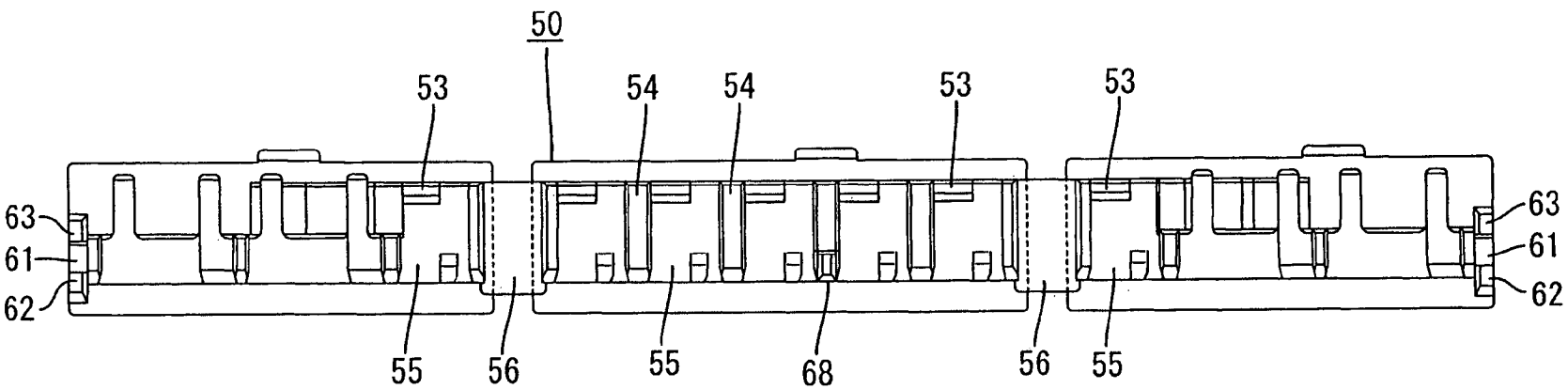
FIG. 3 is a plan view showing the retainer.

Each terminal fitting 30 is formed by bending a metal plate to define a long narrow structure with opposite front and rear ends. As shown in FIG. 2, a tubular connection part 31 is formed adjacent the front end of the terminal fitting 30 and is configured to receive a mating male terminal fitting (not shown). A barrel 32 is formed rearward of the tubular connection part 31 and is configured to be crimped into connection with an end of an electric wire 80.

Figure 1:
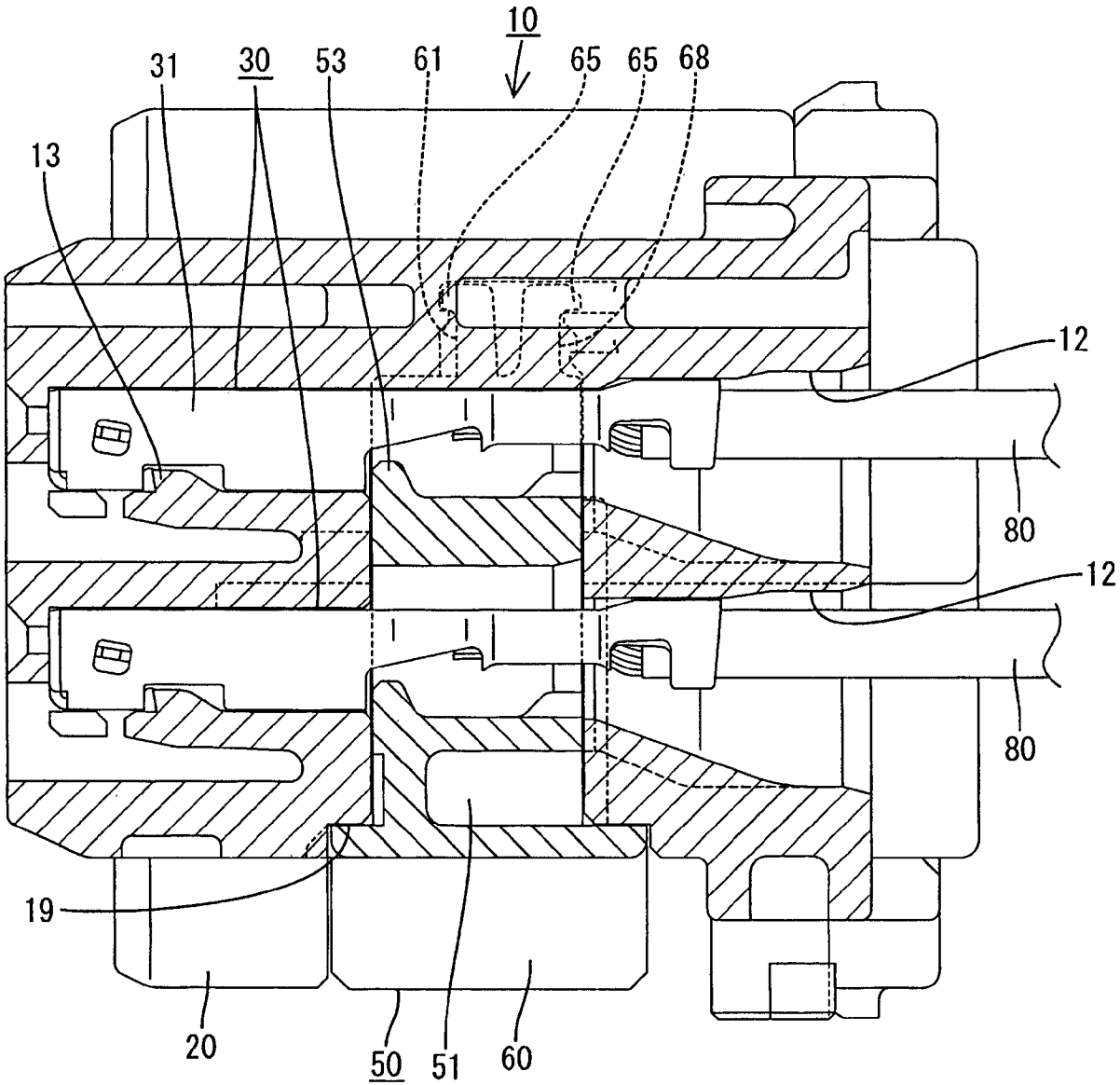
FIG. 1 is a sectional view showing a state in which a retainer is disposed at a main locking position in one embodiment of the present invention.
Figure 5:
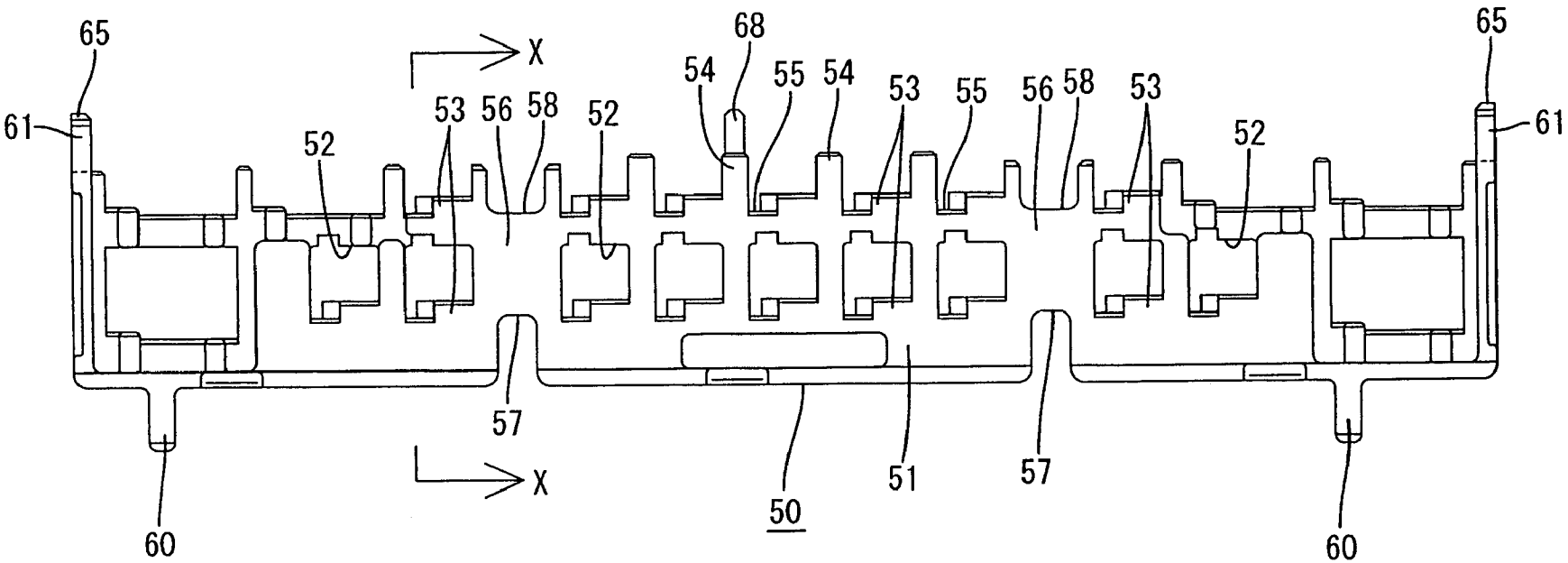
FIG. 5 is a front view showing the retainer.

The connector further includes a retainer 50 that is molded unitarily from a synthetic resin. As shown in FIG. 5, the retainer 50 has a wide flat base 51. Windows 52 extend through the base 51 and are arranged side-by-side in positions corresponding to the positions of the lower stage cavities 12 of the housing 10. A locking projection 53 is formed at a front portion of a lower surface of each window 52. Grooves 55 are arranged side-by-side on the top side of the base 51 and in positions corresponding to the positions of the upper stage cavities 12 in the housing 10. Each groove 55 sandwiched between a pair of side walls 54. A locking projection 53 is formed at a front portion of a lower surface of each groove 55. As shown in FIG. 1, the locking projections 53 can be locked respectively to the tubular connection parts 31 of the terminal fittings 30 inserted properly into the corresponding cavity 12.

Connecting portions 56 are formed on the base 51 at positions corresponding to the partitioning walls 15, and tunnel-shaped escape grooves 57 are formed on lower surfaces of the connecting portions 56. The escape grooves 57 communicate with the guide grooves 16 of the housing 10, and thus help guide the connection of the male and female connectors. Fit-in grooves 58 are formed on the upper surfaces of the connection portions 56 and are sandwiched between the side walls 54. Each fit-in groove 58 fits in a rib 18 of the retainer-mounting hole 17 of the housing 10 to position the retainer 50 in a widthwise direction.

A lower part of the base 51 is substantially plate-shaped and is configured to close the opening of the retainer-mounting hole 17. Front and rear longitudinal ends of the plate-shaped lower part of the base 51 contact the steps 19 (see FIG. 1) of the housing 10 when the retainer 50 is mounted in the retainer-mounting hole 17 at a predetermined normal depth to limit insertion of the retainer 50.

Left and right detectors 60 project down substantially symmetrically from positions near the left and right sides of the lower surface of the base 51. The detectors 60 are substantially flat plates that extend longitudinally over the whole length of the lower surface of the base 51 at widthwise positions corresponding to the positions of the detector 20 of the housing 10. However, the detectors 20 of the housing 10 are forward of the detectors 60 of the retainer 50.

The detectors 20 and 60 are substantially coplanar with each other and extend longitudinally when the retainer 50 is mounted in the retainer-mounting hole 17. Additionally, lower ends of the detectors 20 and 60 are substantially flush with each other when the retainer 50 is mounted in the retainer-mounting hole 17 at the predetermined normal depth (see FIG. 12). However, the lower ends of the detectors 60 of the retainer 50 are offset below the lower ends of the detectors 20 of the housing 10 when the retainer 50 is mounted in the retainer-mounting hole 17 at a depth shorter than the predetermined normal depth. Thus, the lower end of the detector 60 of the retainer 50 is exposed to the outside from the front when the retainer 50 is mounted in the retainer-mounting hole 17 at a depth shorter than the predetermined normal depth (see FIG. 11 or FIG. 13). Therefore, it is easy to detect whether the retainer 50 has been inserted normally inserted into the retainer-mounting hole 17 by visually checking the levels of the lower ends of the detectors 20 and 60.

Figure 4:
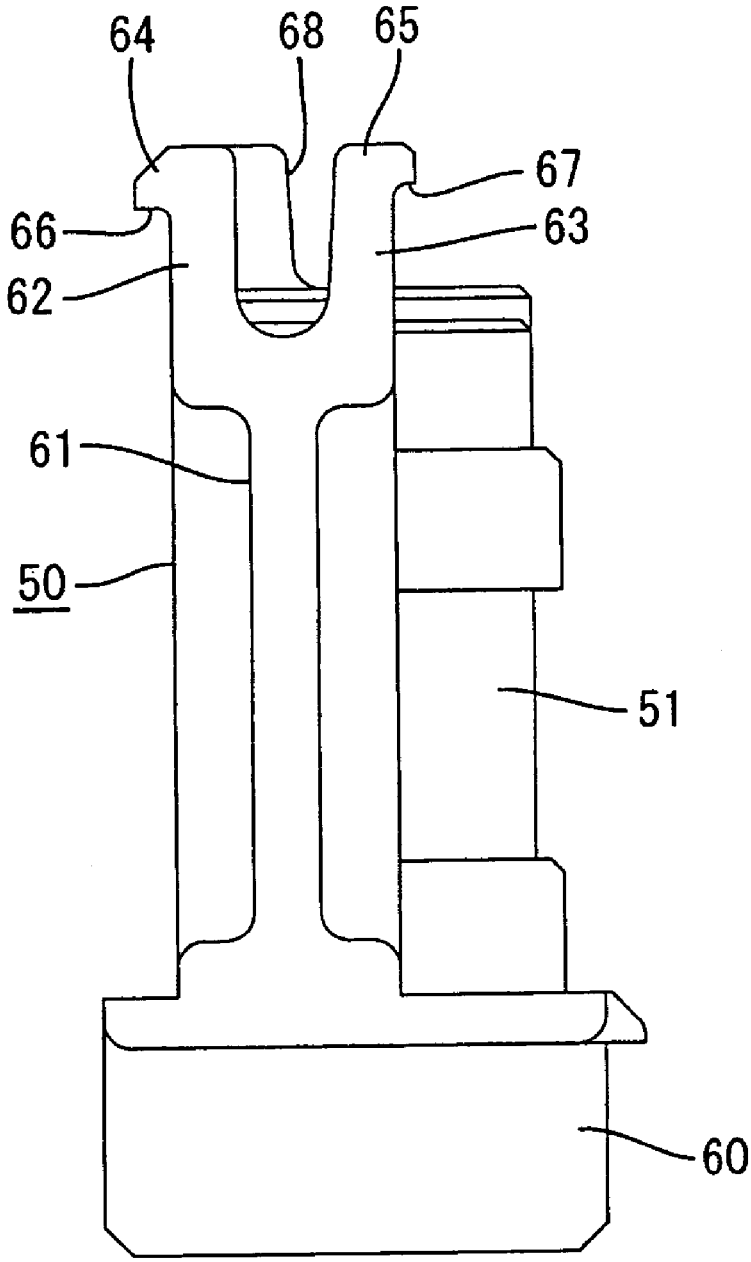
FIG. 4 is a side view showing the retainer.

Right and left side locks 61 are formed on the retainer 50 at the respective left and right ends of the base 51 and at positions to be received in the right and left to-be-locked portions 23 formed in the retainer-mounting hole 17 of the housing 10. As shown in FIG. 4, each of the side locks 61 is bifurcated midway in a vertical direction to form an elastically deformable temporary locking leg 62 that projects up at the rear of the base 51 and an elastically deformable main locking leg 63 that projects up at the from of the base 51. The temporary and main locking legs 62 and 63 have almost the same height and upper ends of the legs 62 and 63 are located above the top of the base 51. In a natural unbiased state, the legs 62 and 63 are substantially parallel with each other and are spaced apart by a selected distance. The temporary locking leg 62 of each side lock 61 functions to hold the retainer 50 at a temporary locking position, whereas the main locking leg 63 of each side lock 61 functions to hold the retainer 50 at a main locking position.

A temporary locking claw 64 projects rearward from the upper end of the temporary locking leg 62 and a main locking claw 65 projects forward the upper end of the main locking leg 63. An approximately horizontal temporary locking surface 66 is formed on the bottom of the temporary locking claw 64 and an approximately horizontal main locking surface 67 is formed on the bottom of the main locking claw 65. The temporary locking surfaces 66 engage the temporary to-be-locked surfaces 21 in the housing 10 and the main locking surfaces 67 engage the main to-be-locked surfaces 22 in the housing 10.

An intermediate lock 68 is formed at a widthwise central position of the retainer 50 between the side locks 61 and at a position corresponding to the intermediate to-be-locked portion 26. The intermediate lock 68 has a main locking leg 63 that projects up from at rear of the base 51. The main locking leg 63 of the intermediate lock 68 has almost the same height as the main locking leg 63 of either side lock 61 and is disposed a little inward from the temporary locking leg 62 of the side lock 61. A main locking claw 65 is formed at the upper end of the main locking leg 63 of the intermediate lock 68, and an approximately horizontal main locking surface 67 is formed on a lower surface of the main locking claw 65 of the intermediate lock 68.

Figure 9B:
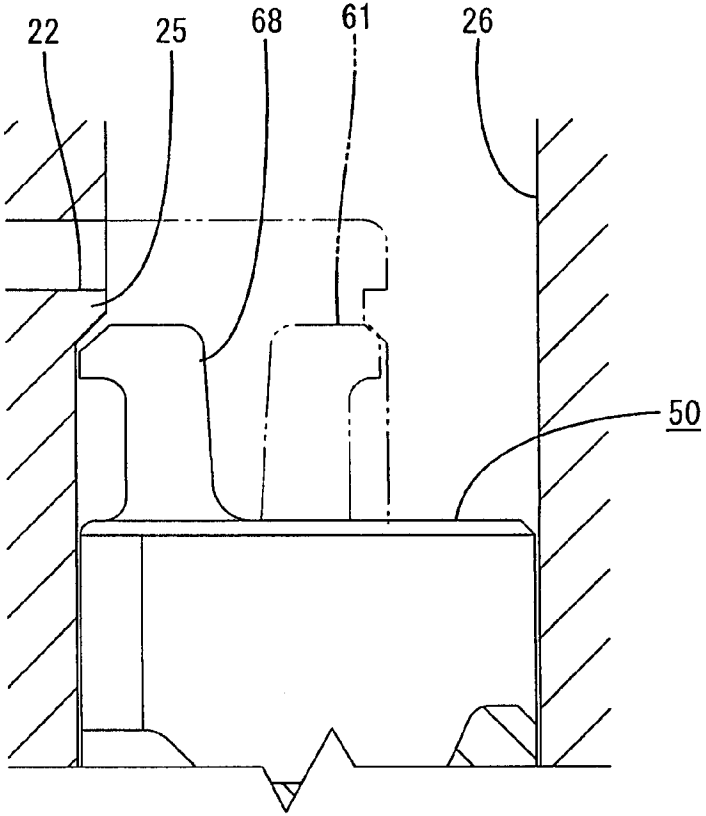
FIG. 9B is a sectional view showing the state of an intermediate locking portion when the retainer is disposed at the temporary locking position.
Figure 9A:
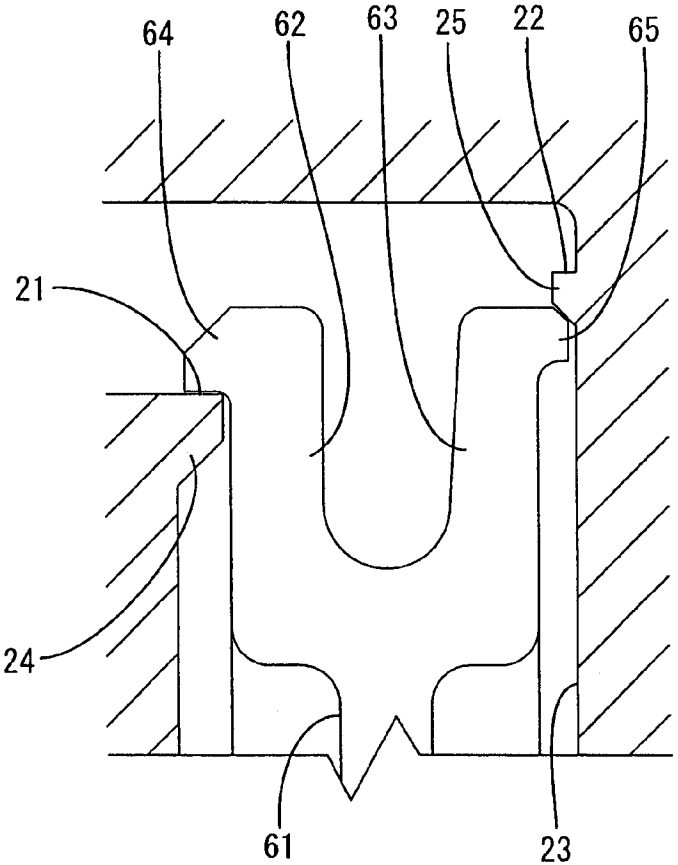
FIG. 9A is a sectional view showing the state of an end-side locking portion when the retainer is disposed at the temporary locking position.
Figure 10A:
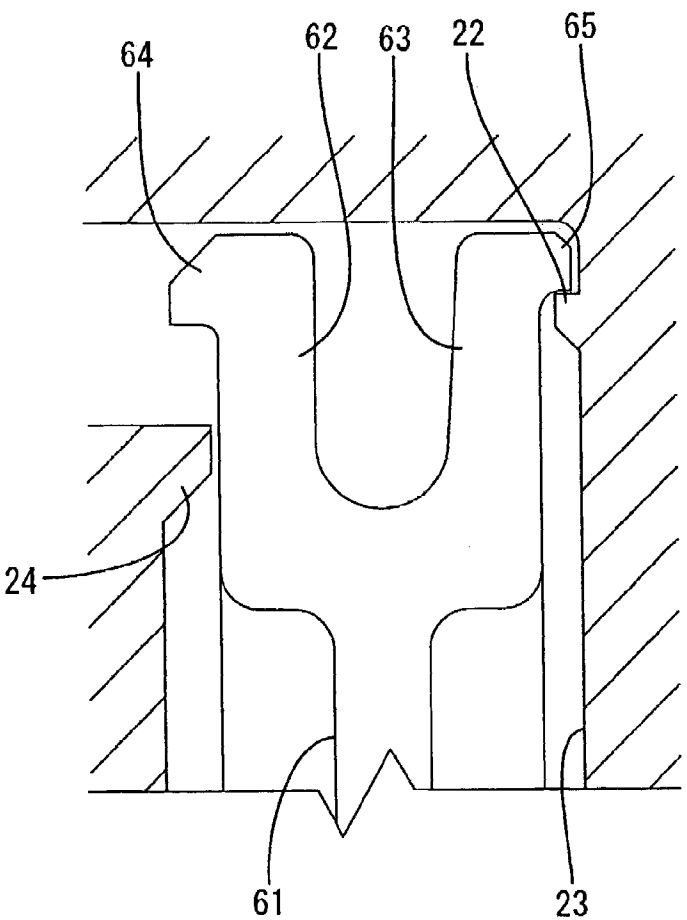
FIG. 10A is a sectional view showing the state of the end-side locking portion when the retainer is disposed at the main locking position.
Figure 11:
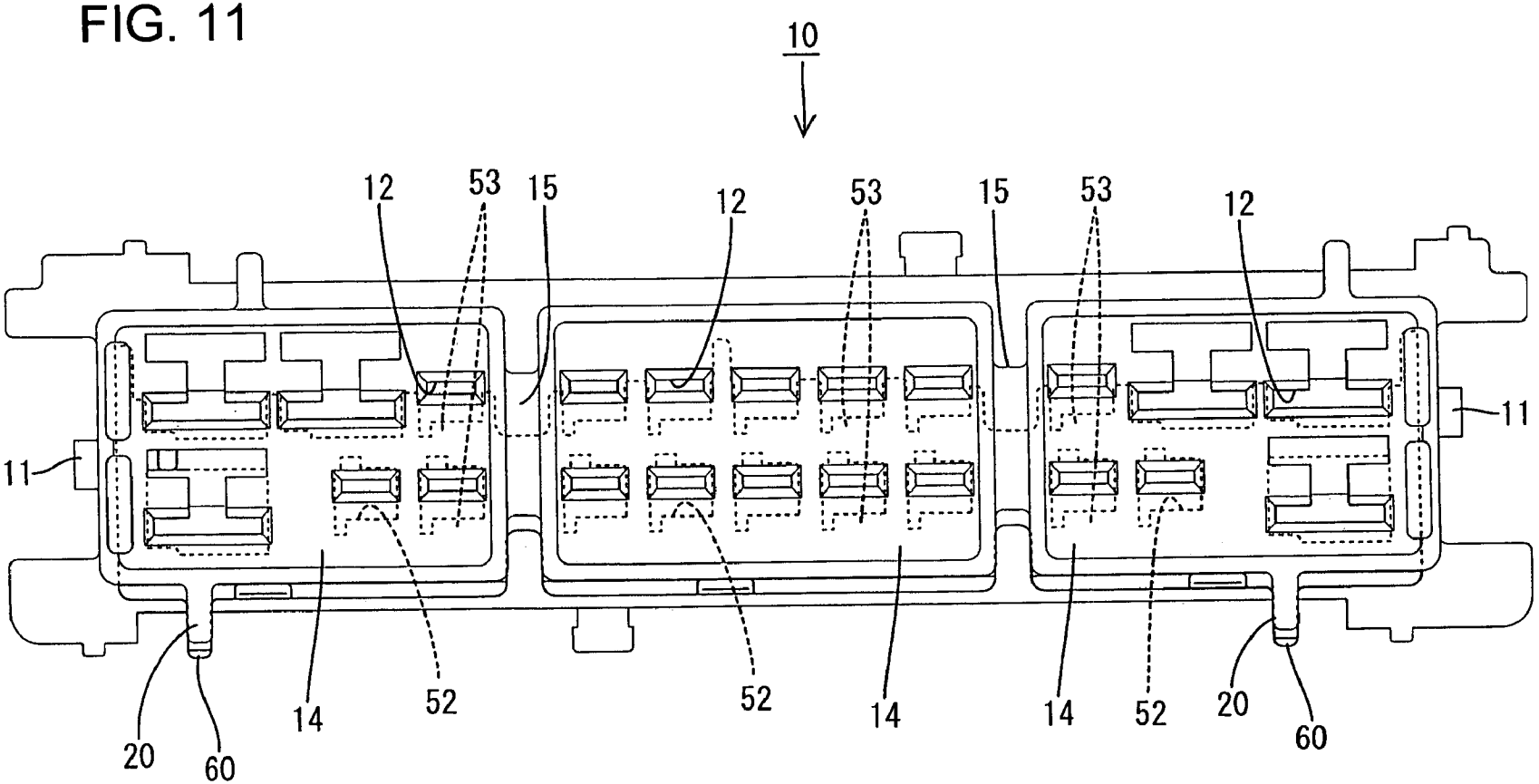
FIG. 11 is a sectional view showing the state in which the retainer is disposed at the temporary locking position.
Figure 12:
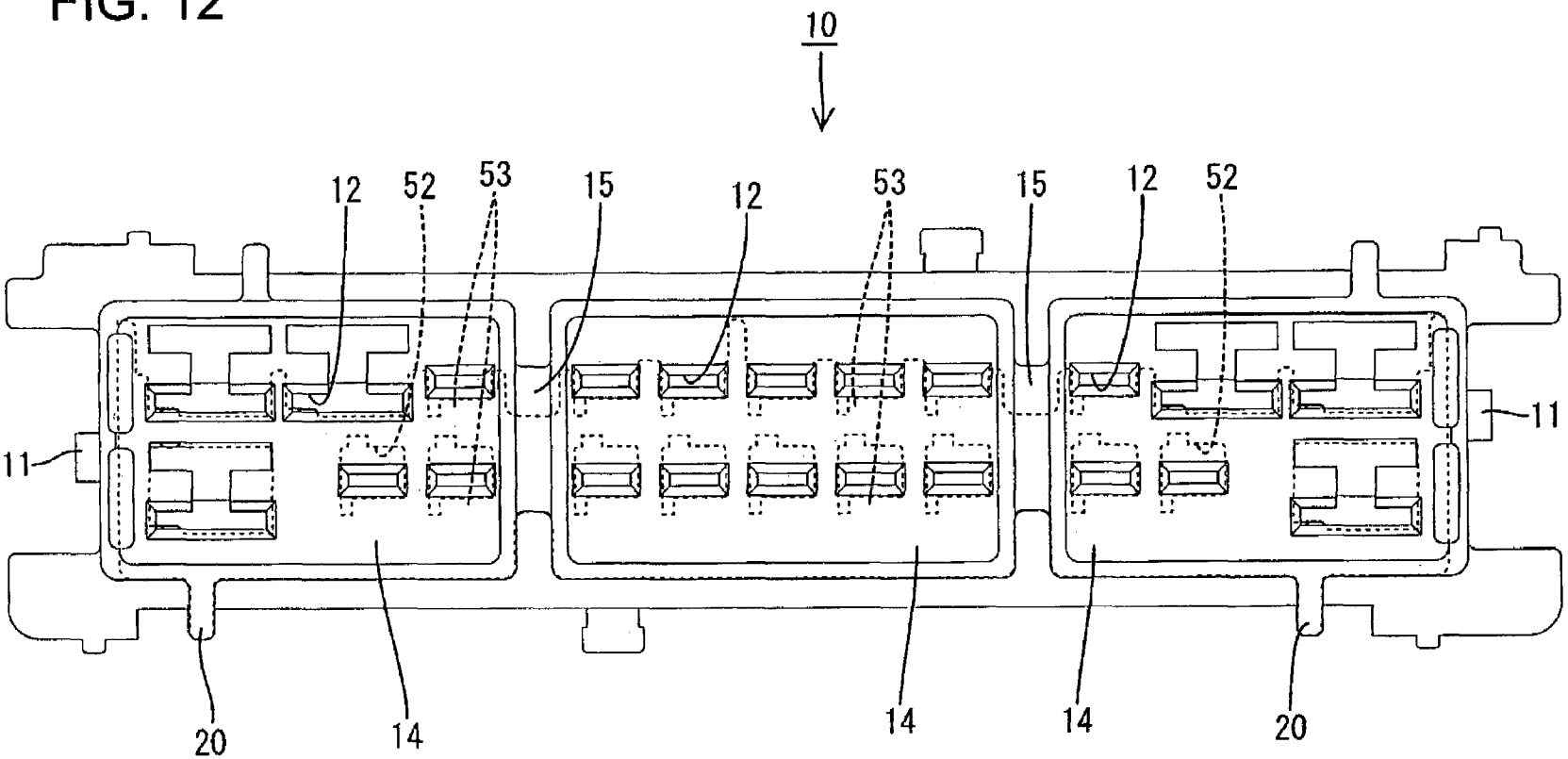
FIG. 12 is a sectional view showing the state in which the retainer is disposed at the main locking position.

When the retainer 50 is at the temporary locking position in the housing 10, the temporary locking claws 64 of the side locks 61 and the temporary locking projections 24 of the housing 10 are locked elastically to each other, as shown in FIGS. 9(A) and 9(B). Thus, the temporary locking surfaces 66 and the temporary to-be-locked surfaces 21 contact each other vertically. In this state, the locking projections 53 of the retainer 50 are disposed away from the cavities 12. As a result, the terminal fittings 30 can be inserted into the cavities 12 and removed therefrom. When the retainer 50 is pressed deeply to the main locking position, the main locking claws 65 formed on the side locks 61 and the intermediate lock 68 of the retainer 50 lock to the main locking projections 25 of the housing 10, as shown in FIGS. 10(A) and 10(B). Thus, the main locking surfaces 67 and the main to-be-locked surfaces 21 contact each other vertically. In this state, the locking projections 53 of the retainer 50 enter the cavities 12 and lock the rear ends of the tubular connection parts 31 of the terminal fittings 30.

An overlap length of the temporary locking surfaces 66 of the side locks 61 with the temporary to-be-locked surfaces 21 exceeds an overlap length Z of the main locking surfaces 67 of the side locks 61 with the main to-be-locked surfaces 22. Thus, the retainer 50 at the temporary locking position will not slip from the housing 10.

Figure 6:
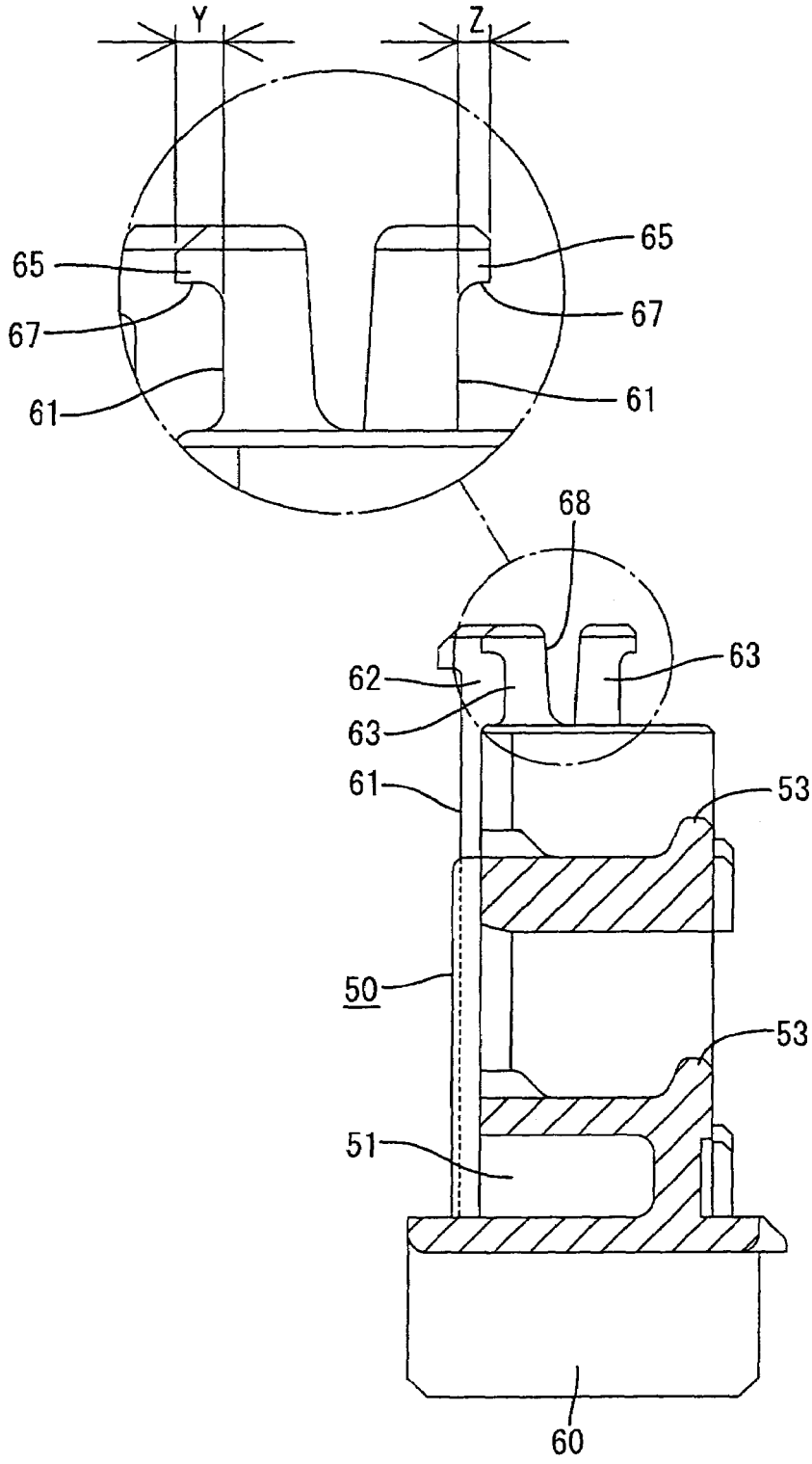
FIG. 6 is a sectional view taken along a line 6—6 of FIG. 5.

As shown in FIG. 6, an overlap length Y of the main locking surface 67 of the intermediate lock 68 with the main to-be-locked surface 22 exceeds an overlap length Z of the main locking surface 67 of the side lock 61 with the main to-be-locked surface 22. Thus, the central portion of the retainer 50 is prevented from deforming up at the main locking position.

The retainer 50 initially is pressed into the retainer-mounting hole 17 of the housing 10 with a small force. As a result, the temporary locking legs 62 of the side locks 61 elastically deform. Accordingly, the temporary locking claws 64 ride across the temporary locking projections 24, and the temporary locking surfaces 66 and the temporary to-be-locked surface 21 are locked to each other (see FIG. 9A). At this time, the upper surfaces of the main locking claws 65 of the side locks 61 contact the lower surfaces of the corresponding main locking projections 25 to resist a retainer-pressing pressing operation. Thus, the retainer 50 is held at the temporary locking position relative to the housing 10 (see FIG. 11).

The terminal fittings 30 then are inserted into the respective cavities 12 of the housing 10 from the rear to a predetermined normal depth. As a result, the terminal fittings 30 are locked primarily to the respective lances 13 (see FIG. 2). The retainer 50 is pressed further when all the terminal fittings 30 are inserted into the respective cavities 12. As a result, the main locking claws 65 of the side locks 61 ride across the corresponding main locking projections 25 due to an elastic deformation thereof. Thus, the main locking surfaces 67 of the side locks 61 and the corresponding main to-be-locked surfaces 22 are locked to each other (see FIG. 10A). At the same time, the main locking claw 65 of the intermediate lock 68 elastically rides across the main corresponding projection 25. Therefore, the main locking surface 67 of the intermediate lock 68 and the corresponding main to-be-locked surface 22 are locked to each other (see FIG. 10B). At this time, forward and rearward longitudinal edges of the lower surface of the base 51 contact the steps 19 of the housing 10 to resist further retainer-pressing. Thus, the retainer 50 is held at the main locking position relative to the housing 10 (see FIG. 12). At the main locking position, each of the locking projections 53 of the retainer 50 are locked to the rear end of the tubular connection part 31 of the corresponding terminal fitting 30. Thus slip-off of the terminal fitting 30 is prevented by the lance 13 that locks the terminal fitting 30 thereto and by the retainer 50 (see FIG.

1). The retainer 50 has the intermediate lock 68 and the side locks 61. Thus, the retainer 50 has a sufficient force for holding the terminal fittings 30 in the widthwise central portion of the housing 10.

A terminal fitting 30 at the widthwise central part of the housing 10 could be left at a semi-inserted state the cavity 12. Thus, the locking projection 53 at the center of the retainer 50 contacts the outer surface of the tubular connection part 31 of the semi-inserted terminal fitting 30 and a further pressing operation is prevented. Therefore the main locking claw 65 of the intermediate lock 68 does not reach the corresponding main locking projection 25 and the terminal fitting 30 in the central part of the housing 10 is not locked. In this case, the retainer 50 could be wide and could have insufficient strength. Thus, there is a fear that the central portion of the retainer 50 will deform elastically up, and that the side locks 61 at both ends of the retainer 50 will be locked (main locking). However, the overlap length Z of the main locking surfaces 67 of the side locks 61 is smaller than the overlap length Y of the main locking surfaces 67 of the intermediate locks 68. Thus, the retainer 50 will not warp and the side locks 61 will not be locked.

A terminal fitting 30 at the widthwise side of the housing 10 could be left in a semi-inserted state. Thus, the locking projection 53 at the end of the retainer 50 contacts the outer surface of the tubular connection part 31 of the semi-inserted terminal fitting 30 and further pressing is prevented. Therefore the main locking claw 65 of the side lock 61 does not reach the corresponding main locking projection 25, and the terminal fitting 30 at the widthwise side of the housing 10 is not locked.

Figure 13:
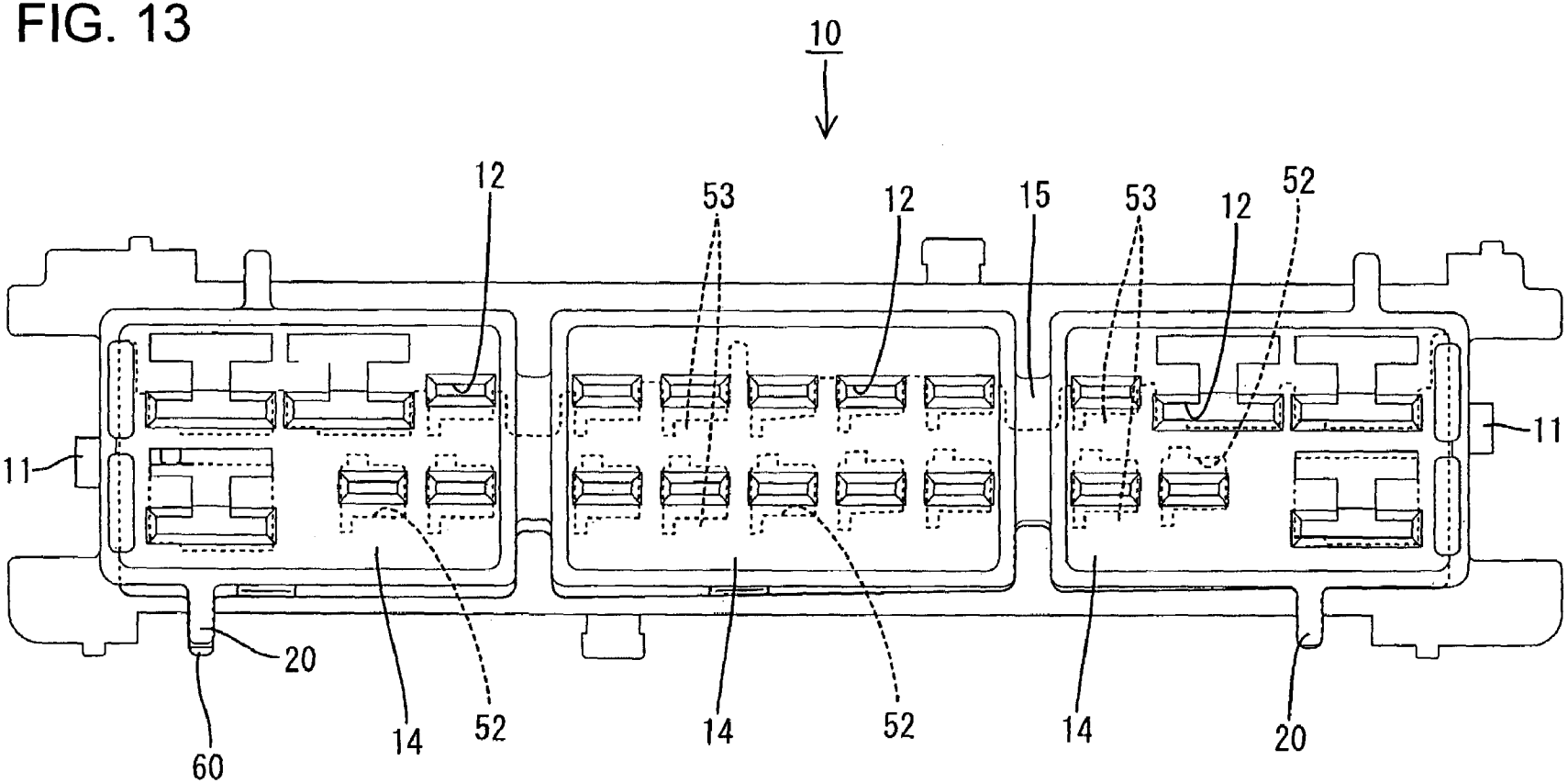
FIG. 13 is a sectional view showing a state in which a terminal fitting has been semi-inserted into a cavity.

As described above, irrespective of the position of the semi-inserted terminal fitting 30, the retainer 50 elastically deforms up at its ends. Thus, as shown in FIG. 13, by visually checking that the level of the lower end of the detector 20 of the housing 10 and the level of the lower end of the detector 60 of the retainer 50 are not flush with each other, it is easy to detect that the terminal fitting 30 is semi-inserted.

Further, the locking strength of the main locking surface 67 is adjusted by setting the overlap length of the main locking surface 67 with the main to-be-locked surface 22 larger at the intermediate lock 68 than at the side lock 61. This way of adjusting the locking strength of the main locking surface 67 allows the connector to be manufactured more easily than adjusting the locking strength by using different materials for the intermediate locks 68 and the side locks 61.

The side locks 61 are at the widthwise sides of the retainer 50, and one intermediate lock 68 is at the widthwise center of the retainer 50. Therefore the retainer 50 is well balanced and mounting can be accomplished smoothly.

The invention is not limited to the above-described embodiment described above with reference to the drawings. For example, the following embodiments are included in the technical scope of the invention. Further, various modifications of the above-described embodiment can be made without departing from the spirit and scope of the present invention.

In the above-described embodiment, the locking strength of the main locking surface of the intermediate lock is made large by setting a larger overlap at the intermediate lock than at the side lock. However, the locking strength may be set large by tapering the main locking surface of the intermediate locking in a direction opposite to a direction in which the retainer is taken out from the housing. In addition, the locking strength may be adjusted by differentiating the elasticity of the main locking leg of the intermediate lock from the elasticity of the main locking leg of the side lock.

In the above-described embodiment, one intermediate lock is disposed at the widthwise central position of the retainer. However, the intermediate lock may be at any position between the side locks. Further the retainer may have a plurality of intermediate locks.

The invention is applicable to a front retainer as well as a side retainer.

The invention is applicable to a male connector as well as the female connector.

What is claimed is:

1. A connector comprising:

a housing with opposite first and second sides spaced from one another in a width direction and cavities arranged substantially side-by-side in at least one row along the width direction of the housing, the cavities being configured for accommodating terminal fittings, a retainer-mounting hole formed in the housing and communicating with the cavities; and a retainer mounted in the retainer-mounting hole and entering the cavities when the retainer is mounted in said retainer-mounting hole at a predetermined normal depth for holding the terminal fittings in the cavities, the retainer having opposite first and second sides disposed substantially at the first and second sides of the housing, first and second side locks disposed respectively at the first and second sides of said retainer and configured to lock to side to-be-locked surfaces of the housing with a selected locking strength, an intermediate lock disposed between said first and second side locks, said intermediate lock being configured to lock to an intermediate to-be-locked surface of the housing with a locking strength greater than the selected locking strength of the side locks.

2. The connector of claim 1, wherein the locking strength of the intermediate lock is made greater than the selected locking strength of the side locks by providing a larger overlap between said intermediate lock of said retainer and said intermediate to-be-locked surface of said housing than between the side locks of said retainer and the side to-be-locked surfaces of the housing.

3. The connector of claim 1, wherein said intermediate lock is disposed substantially centrally between the first and second sides of the retainer.

4. The connector of claim 1, further comprising at least one detector projecting from said housing and at least one detector projecting from the retainer, said detectors being substantially flush with one another when said retainer is mounted in said retainer-mounting hole at a predetermined normal depth, and the detectors being misaligned when said retainer is not mounted in said retainer-mounting hole at the predetermined normal depth.

5. The connector of claim 4, wherein said retainer can be mounted in said retainer-mounting hole at the predetermined normal depth when the terminal fittings are mounted properly in the cavities of the housing, and wherein any one of the terminal fittings that is not mounted properly in the respective cavity prevents said retainer from being mounted in said retainer-mounting hole at the predetermined normal depth.

6. The connector of claim 5, wherein the at least one detector projecting from said housing comprises a plurality of said detectors projecting from the housing and wherein the at least one detector projecting from the retainer comprises a plurality of detectors projecting from the retainer.

7. The connector of claim 6, wherein the housing has opposite front and rear ends, the cavities extending into the rear end and continuing towards the front end, the detectors being formed on the housing between the retainer-mounting hole and the front end of the housing.

8. The connector of claim 1, wherein the side locks include means for selectively locking the retainer in the retainer-mounting hole at either of a temporary depth and at a normal depth, the retainer being configured to permit insertion of the terminal fittings into the cavities when the retainer is at the temporary depth and being configured to lock the terminal fittings in the cavities when the retainer is at the normal depth.

9. The connector of claim 8, wherein the housing is formed with at least one step for engaging the retainer and preventing insertion of the retainer beyond the normal depth.

10. The connector of claim 1, wherein the side locks and the intermediate lock each have at least one locking leg and a locking claw at a projecting end of the locking leg, a projecting distance of the locking claw from the locking leg being greater on the intermediate lock than on either of the side locks.

* * * * *